US006347147B1

(12) United States Patent
Downs, Jr. et al.

(10) Patent No.: US 6,347,147 B1
(45) **Date of Patent: *Feb. 12, 2002**

(54) HIGH NOISE SUPPRESSION MICROPHONE

(75) Inventors: Edward F. Downs, Jr., Lynn Haven; Kevin M. Venturella, Panama City Beach, both of FL (US)

(73) Assignee: The United States of America as represented by the Sceretary of the Navy, Washington, DC (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/207,903

(22) Filed: Dec. 7, 1998

(51) Int. Cl.[7] ..... H04R 3/00
(52) U.S. Cl. ..... 381/114
(58) Field of Search ..... 381/114, 173, 381/71.1, 190; 340/384.6, 384.73; 310/326, 327, 328

(56) References Cited

U.S. PATENT DOCUMENTS 3,440,352 A * 4/1969 Boll ..... 381/114
4,156,800 A * 5/1979 Sear et al. ..... 381/114
4,535,205 A * 8/1985 Ravinet et al. ..... 381/114
4,598,417 A * 7/1986 Deno ..... 381/114
4,696,045 A * 9/1987 Rosenthal ..... 381/114
5,161,200 A 11/1992 Barr ..... 381/190
5,889,871 A 3/1999 Downs ..... 381/190

FOREIGN PATENT DOCUMENTS

JP 0016800 1/1988 ..... 381/190

* cited by examiner

*Primary Examiner*—Minsun Oh Harvey
(74) *Attorney, Agent, or Firm*—Harvey A. Gilbert; Donald G. Peck

(57) ABSTRACT

A noise suppressing microphone employing a thin film of piezoelectric material sandwiched between two conductive layers, one of which is laminated to a flat inflexible laminate. The sandwich is embedded in a mechanical sound filter except for one exposed face which is placed in contact with a user's body for sound pickup. The filter is composed of sound dissipating material, alone or in complementary configurations, and in sandwiches including a sound absorbing and sound reflecting metal layer, or a pillow of mastic-like sound-deadening material

13 Claims, 2 Drawing Sheets

HIGH NOISE SUPPRESSION MICROPHONE

INTRODUCTION

The present invention relates to communications and particularly voice communications. More particularly, the present invention relates to a noise suppressing microphone apparatus for high clarity two way radio communications in high noise, and environmentally extreme conditions.

BACKGROUND OF THE INVENTION

Two-way radio communications in high noise, environmentally extreme conditions is difficult, or often impossible. Such communications are often erratic, intermittent, and subject to various forms of environmental and operational interference and disruption. This is particularly true where high noise levels, moisture, and other challenging conditions of the particular applications environment are simultaneously effective. Such conditions are commonly found in military applications involving high-noise operations in the air such as helicopters and other types of aircraft, on the surface, such as tanks, air-cushion vehicles, and personnel carriers, and on or beneath the surface of a body of water, such as high speed boats, air-cushion watercraft, and submersibles.

Likewise, civilian applications include, but are not limited to, motorcycles, jet skis, skydiving, motor boating, firefighting, video games, voice input to computers, police work, voice recognition for computers, and hazardous materials applications. In most, if not all of such exemplary applications, hands-free operation is desirable, if not essential.

The environmental exposure to which such a microphone may be subjected includes high and low temperature, extraordinary shock and vibration effects during handling and use, high levels of audible sound interference, moisture, toxic, and chemically damaging agents. One of the best examples of an environment containing the broadest spectrum of challenging and extreme environmental factors is that of firefighting. The firefighting application demands the use of special apparel such as gloves, helmet liners, and face and eye protective elements that may contribute adversely to the use and operational effectiveness of prior art microphones.

Prior art conventional microphones are typically positioned on a boom in front of the user's mouth to pick up speech. In this location, the microphone will pick up ambient background noise including wind and breathing noise, and other external noise. Also, microphones mounted on or within a helmet or mask worn by a user are prone to pick up not only the aforementioned sounds but resonation's and reverberations of same. Such noise may completely drown out or obscure otherwise intelligible voice communications. Noise cancellation provided by special circuitry may be applied to the microphone output to achieve some degree of improvement. Such circuitry requires a power source and physical and functional support.

SUMMARY OF THE INVENTION

It is thus an object of the present invention to provide a microphone having noise suppression capability for use in a high-noise operationally challenging environment.

It is yet another object of the present invention to provide a solid state microphone having integrated mechanical noise filtration.

It is still another object of the present invention to provide a piezoelectric microphone having integrated mechanical noise filtration.

These and other features and advantages of the present invention will become apparent to those skilled in the art upon a reading of the following detailed description when taken in conjunction with the drawings wherein there is shown and described an illustrative embodiment of the invention.

The present invention, the Noise Suppressing Microphone, is a piezoelectric sandwich transducer embedded in a mechanical noise filter, except for one transducer face employed for contact with the user's body for pickup of user-created sound. The sandwich is a thin layer of piezoelectric film between two conductive thin film metallic layers to which output leads are attached. The sandwich is securely mounted to a flat, substantially inflexible substrate. This assembly is covered by a hydrophobic coating and then embedded in a single or multiple layer mechanical sound suppressing filter. The filter absorbs and dissipates ambient sound impinging on the filter material surrounding those portions of the transducer not in direct contact with the user's body.

The microphone of the present invention is particularly effective when used in contact with the user's forehead. However, using the invention to detect maximum sound pickup at various points on the user's body will permit optimum location for a particular application.

BRIEF DESCRIPTIONS OF THE DRAWINGS

DETAILED DESCRIPTION

Figure 1:
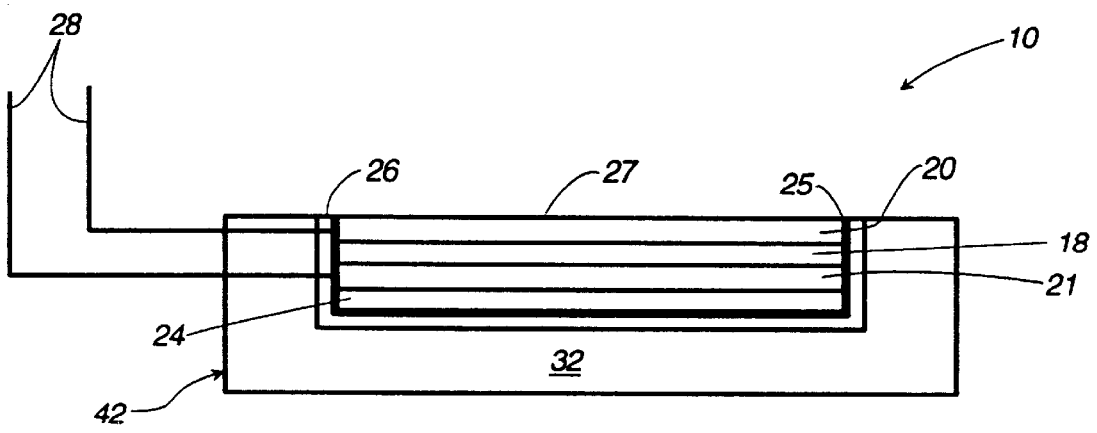
FIG. 1 is side view of the microphone embedded in a single layer filter.

Referring to FIG. 1, the microphone assembly 10 of the present invention, the High-Noise Suppression Microphone is shown.

A thin piezoelectric-film 18, made for example of polyvinylidene fluoride (PVDF), is sandwiched between two conductive layers 20 and 21, which may be thin metallic films. This forms a piezoelectric sandwich element, or more specifically a PVDG sandwich element. The conductive film layers 20 and 21 coat the bottom and top surface of the piezoelectric film 18 and are constructed from conductive material such as aluminum or nickel. Wires 28 for connections from the sandwich are attached to the top 20 and bottom 21 conductive layers using silver epoxy. The sandwich element is then firmly mounted or laminated on a solid, flat, substantially inflexible, substrate 24, which is preferably a piece of printed circuit board or equivalent material.

Figure 4:
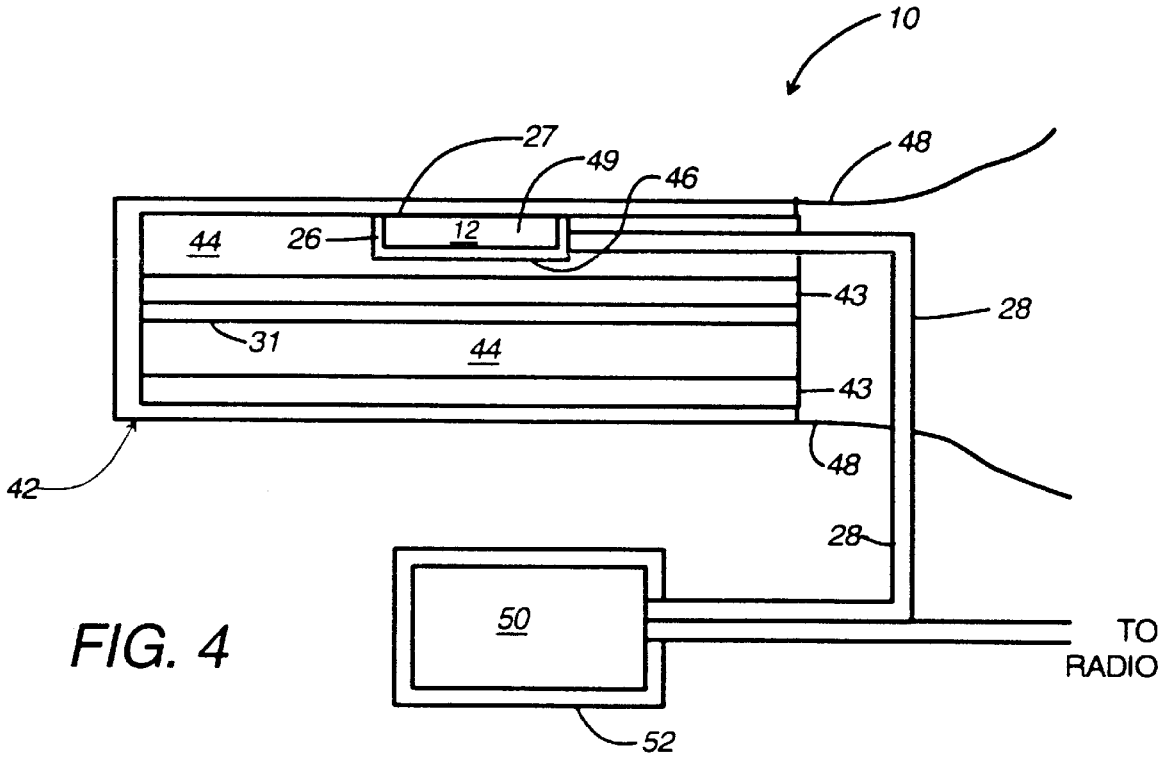
FIG. 4 is a side view of the microphone embedded in another version of a multi-layer sandwich filter.

The wires 28 connected to conductive layers 20 and 21 are connected to the inputs of an impedance matching circuit 50 shown in FIG. 4 to address the high natural impedance of the piezoelectric sandwich. Details of the impedance matching and power connections are discussed in U.S. patent application Ser. No. 08/136,856, as they are not essential to the disclosure and description of the present invention.

Figure 2:
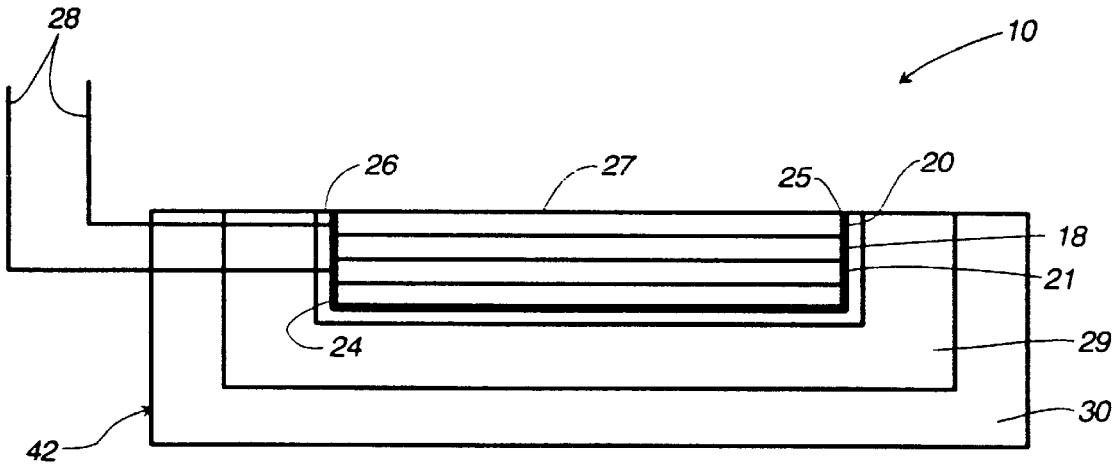
FIG. 2 is a side view of the microphone embedded in a multi-layer filter.
Figure 3:
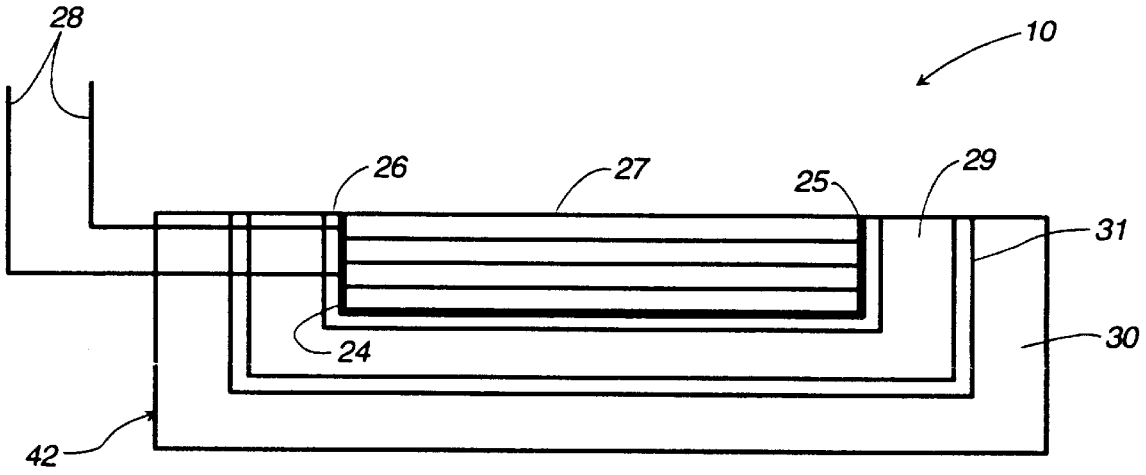
FIG. 3 is a side view of the microphone embedded in a multi-layer sandwich filter.

Referring to the side views shown in FIGS. 1, 2, and 3, the piezoelectric sandwich comprising piezoelectric film 18 and conductive films 20 and 21 is shown affixed to the circuit board which forms the inflexible substrate 24. The substrate 24 is laminated to the piezoelectric sandwich along substantially the entire surface of one of the two conductive layers 21. This sandwich has a square form of 0.75 inch by 0.75 in one preferred embodiment.

A ground shield 25 is preferably placed about the piezoelectric sandwich except for the exposed face 27 and another ground shield 52, as shown in FIG. 4, over the impedance matching circuit if located separately, to allow use in an environment of high electromagnetic interference.

The surface of the film and circuit board is then covered with a hydrophobic epoxy layer 26 to provide environmental protection against water intrusion that would short out the piezoelectric film destroying its ability to function. The necessity in harsh environmental conditions of providing such a water-resistant layer is a primary reason why diaphragm-based piezoelectric microphones will not work under the conditions for which the present invention is needed. The above-described piezoelectric sandwich is embedded in a mechanical noise filter 42. All faces of the sandwich are embedded in the filter except for the face of the piezoelectric sandwich opposite the face to which the substrate 24 is laminated. The noise filter 42 provides ambient noise suppression by means of absorption, dissipation, reflection, and other means, alone, and in combination. The filter 42 must be a single layer 32 of sound suppression or sound dissipating material as shown in FIG. 1, multiple layers 29 and 30 of complementary sound suppression material, as depicted in FIG. 2, a sandwich of complementary sound suppression material including layers 29 and 30 and a reflective and re-directive metal barrier layer 31 in-between, as shown in FIG. 3, and a sandwich of multi-layer composite layers 43 and 44 of complementary sound suppression materials including a reflective and re-directive metal barrier layer 31 in-between as shown in FIG. 4.

In the embodiment of the microphone assembly 10 in FIG. 1, the noise filter 42 has a single layer 32 of sound suppression or sound dissipating material which absorbs impinging ambient sound energy. Material used for a single layer noise filter 32 includes sound absorbing film having an approximate weight of 0.2 lbs./sq. ft.

In the embodiment of the microphone assembly 10 in FIG. 2 employing a two layer 29, 30 noise filter 42, complementary sound suppression or dissipating materials are selected to maximize the amount of sound energy absorption and thus virtually eliminate ambient sound or noise reaching the piezoelectric film 18. The complementary sound suppression layers 29 and 30 may be made from various density rubber, rubber and foam composites, and polymeric materials having desirable sound energy absorbing characteristics.

In the embodiment of the microphone assembly 10 in FIG. 3, the noise filter 42 employs a metal layer 31 sandwiched between a first layer 29 of noise suppression material and a second layer 30 of noise suppression material. The sound absorbing materials for layers 29 and 30 are as described above for the filter 42 without the metal layer 31. The sandwiched metal layer 31 acts as a reflector and absorber of sound energy in this arrangement. Any sound energy not absorbed and dissipated by entry layer 30 is in part reflected back into layer 30 and in part dissipated and communicated into inner layer 29. The overall suppression of ambient sound reaching the piezoelectric film 18 with this filter 42 configuration is measurably better than the single layer 32 filter and the double layer 29 and 30 filter (FIG. 2) without the reflective dissipating metal layer 31. The metal lead has been found particularly effective for use as the metal layer 31, however, other metals may be used. In lieu of the metal layer, a pillow-like layer of mastic-like sound deadening material may be substituted. A mastic like floor tile adhesive offers excellent sound dissipating qualities.

In FIG. 4 the filter 42 is a sandwich of two multi-layer laminates of sound suppression and dissipation materials with a metal layer 31 in-between. Each multi-layer laminate consists of a layer 43 of high density material bonded or otherwise secured to a layer 44 of low-density material. Exemplary of such material is a 5/16 inch thick composite material known as Quiet-Mat DSB-1 by Noise Reduction Enterprises of Essex, Mass. This material is a laminate of 1 lb./sq.ft. high-density sound barrier bonded to a ¼ inch foam decoupler. In this configuration, as above, a pillow-like layer of mastic-like material may be substituted for the metal layer for some applications.

FIG. 4 shows the arrangement of the epoxy sealed microphone element 41 installed in the metallic lead receptacle 49, which rests in the cavity 46 in the filter 42. More particularly the cavity 46 is shown located in the layer 44 of low-density material. The leads 28 for connecting the microphone element 12 to the impedance matching device 50 for ultimate connection to a radio are shown in FIG. 4.

Although the invention has been described relative to a specific embodiment thereof, there are numerous variations and modifications that will be readily apparent to those skilled in the art in light of the above teachings. Thus, for example, other combinations of materials of high and low-density sound absorbing capacity may be used for particular applications. The use of confined or pillow-like mastic or gel-like layers between the layers of high and low density laminates and between these laminates and each side of a metal sheet 31 provides another means for dissipating ambient sounds constituting noise to clear communication. Thus it is, therefore, to be understood that, within the scope of the appended claims the invention may be practiced other than as specifically described.

What we now claim for our invention is:

1. A high-noise suppression microphone, comprising:

a. A film of piezoelectric material having two opposite faces, b. Two thin films of conductive material, one of said films of conductive material being affixed to one of said two opposite faces and another of said films of conductive material being affixed to another of said two opposite faces, thereby forming a piezoelectric sandwich element with the thin film of piezoelectric material in between the two thin films of conductive material such that a first face of the piezoelectric sandwich element is defined by said one of said films of conductive material and such that a second face of the piezoelectric sandwich element is defined by said another of said films of conductive material, c. A flat, substantially inflexible substrate laminated to the piezoelectric sandwich element along substantially the entire surface of the first face of the piezoelectric sandwich element, d. Two connecting conductors connected to the two films of conductive material for carrying an electrical signal between the piezoelectric sandwich element and some external point, and e. An ambient noise filter embedding the piezoelectric sandwich element and inflexible substrate except for the second face of the piezoelectric sandwich element for substantially preventing sound impinging on the noise filter from reaching the film of piezoelectric material.

2. The microphone of claim 1 wherein said noise filter is one layer of noise suppresion material.

3. The microphone of claim 1 wherein said noise filter is a multi-layer arrangement of materials.

4. The microphone of claim 3 wherein the multi-layer arrangement includes sound reflective and sound absorptive material layers.

5. The microphone of claim 4 wherein each sound reflective material layer is a metal.

6. The microphone of claim 4 wherein each sound absorptive material layer is a non-metal composite.

7. The microphone of claim 3 wherein each layer of the multi-layer arrangement is of elastic and non-metal composition.

8. The microphone of claim 5 wherein each sound reflective material layer is sandwiched between two of the sound absorptive material layers.

9. The microphone of claim 1 wherein the noise filter consists of a first and second composite layer, each said first and second composite layer comprising a layer of high-density rubber-like material laminated to a layer of foam decoupler, said first and second composite layers bonded together such that the high-density layer of said first composite layer is in contact with the foam decoupler layer of said second composite layer.

10. The microphone of claim 9 wherein a metal sheet is bonded in between said first and second composite layer such that the high-density side of said first composite layer is in contact with one side of said metal sheet and the foam decoupler side of said second composite layer is in contact with the opposite side of said metal sheet.

11. The microphone of claim 10 further comprising a ground shield interposed between the noise filter and the piezoelectric sandwich element to protect the piezoelectric sandwich element from electromagnetic interference.

12. The microphone of claim 1 further comprising a water-resistant protection layer encasing the combination of the piezoelectric sandwich element and the inflexible substrate laminated thereto for protection of the piezoelectric sandwich element against environment moisture.

13. The microphone of claim 3 wherein the multi-layer arrangement is two layers of sound absorbing material sandwiched about a layer comprising a pillow of mastic-like sound deadening material.

* * * * *